United States Patent [19]

Buck

[11] Patent Number: 4,693,696

[45] Date of Patent: Sep. 15, 1987

[54] INFLATED BALLOON TIRE FOR TOY VEHICLES

[76] Inventor: Gordon H. Buck, 3784 Newton St., Torrance, Calif. 90505

[21] Appl. No.: 822,787

[22] Filed: Jan. 27, 1986

[51] Int. Cl.[4] ..... A63H 306; A63H 17/00; B60B 9/00; B60B 21/10

[52] U.S. Cl. ..... 446/224; 446/465; 152/9; 152/415; 152/379.3

[58] Field of Search ..... 446/85, 86, 88, 93, 446/95, 220, 223, 224, 225, 431, 465, 469, 470; 152/9, 5, 7, 379.3, 379.4, 379.5, 380, 381.4, 382, 383, 388, 389, 391, 396, 398, 415, 418

[56] References Cited

U.S. PATENT DOCUMENTS

| | | | |
|---|---|---|---|
| 1,765,858 | 6/1930 | Anderson | 152/5 |
| 2,141,645 | 12/1938 | Fawick | 152/379.3 X |
| 2,206,438 | 7/1940 | Trexler | 152/9 X |
| 2,231,745 | 2/1941 | Altmyer | 152/9 |
| 2,242,915 | 5/1941 | Koski | 152/7 |
| 2,404,269 | 7/1946 | Bennett | 152/9 |
| 2,792,669 | 5/1957 | Jackson et al. | 446/224 |
| 3,006,692 | 10/1961 | Schubert | 152/381.4 X |
| 3,174,455 | 3/1965 | Peterson | 446/220 X |
| 4,058,344 | 11/1977 | Dyson | 152/7 X |
| 4,305,621 | 12/1981 | Snell et al. | 152/415 X |

FOREIGN PATENT DOCUMENTS

| | | | |
|---|---|---|---|
| 1276530 | 8/1968 | Fed. Rep. of Germany | 446/465 |
| 2409994 | 9/1974 | Fed. Rep. of Germany | 152/9 |
| 926008 | 9/1947 | France | 446/465 |

*Primary Examiner*—Robert A. Hafer
*Assistant Examiner*—D. Neal Muir
*Attorney, Agent, or Firm*—Plante Strauss Vanderburgh

[57] ABSTRACT

A toy wheel formed with a balloon tire and hub is disclosed in which the tire can be inflated with a valve mechanism contained within the hub of the wheel. The hub is an assembly of hub and cap members which are interlocked together. The tire is a balloon with a single central opening at one end which is received over the hub, and the opposite end of the balloon is captured between the interlocked hub and cap members. The inflation valve comprises an air passageway through the hub member which is surrounded by a valve seat on its inside end. The valve seat is intersected with at least one axial slot along the inside end of the hub member to provide a release air passageway. The valve seat is preferably sealed by a sealing portion of the balloon. A pin with an enlarged diameter head is received in the air passageway to provide a valve operator which, when depressed, lifts the sealing portion of the balloon off the valve seat and releases the air pressure through the axial slot. In another embodiment, the valve operator can be provided with a valve member and a spring to bias it closed, against the valve seat on the hub member.

24 Claims, 15 Drawing Figures

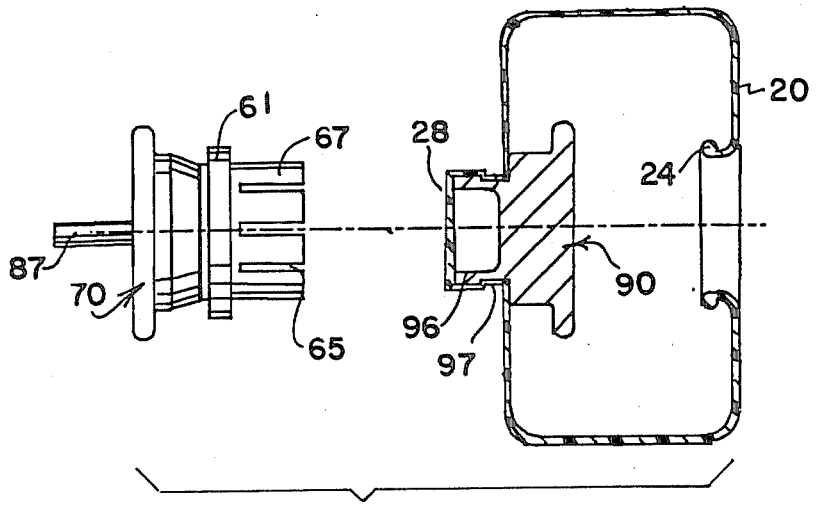
FIG. 4
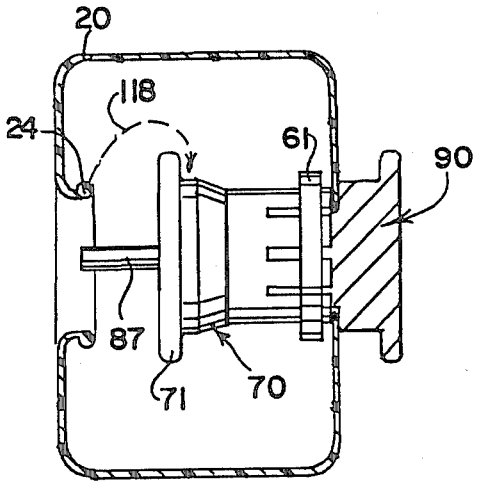
FIG. 5
FIG. 6
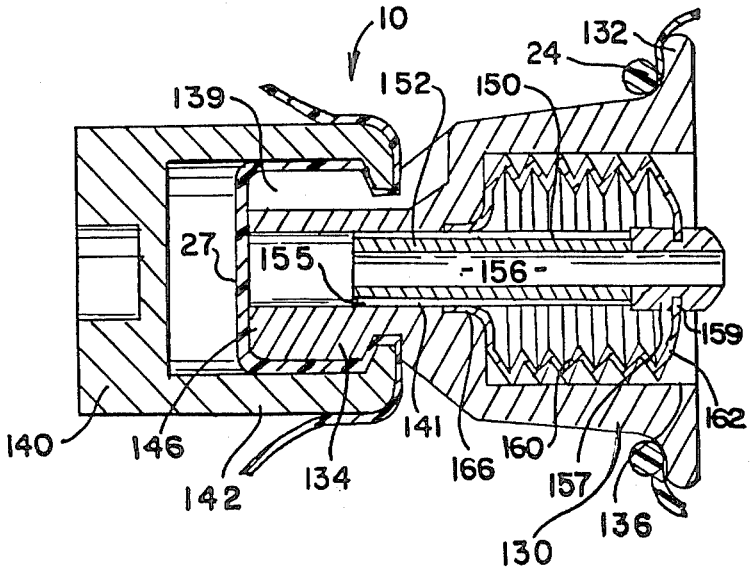

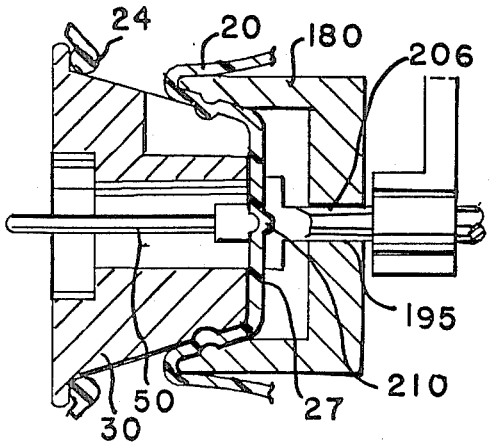
FIG. 12
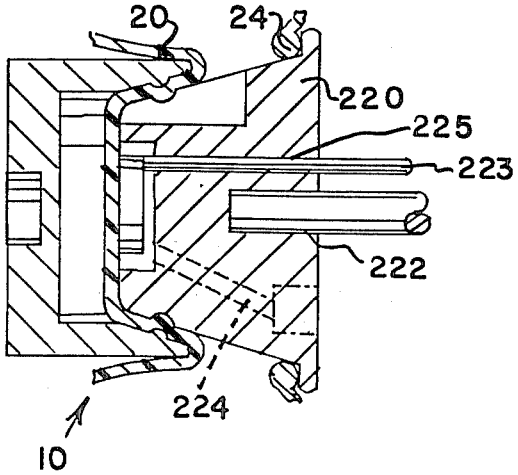
FIG. 13
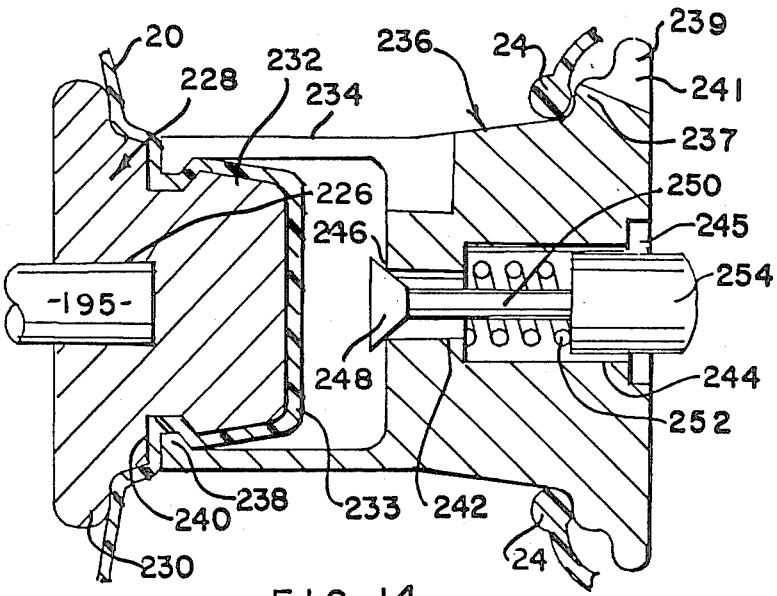
FIG. 14
FIG. 15
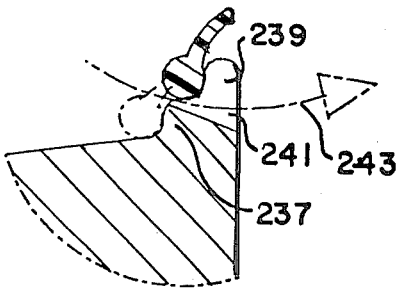

INFLATED BALLOON TIRE FOR TOY VEHICLES

BACKGROUND OF THE INVENTION

1. Field of the Invention

This invention relates to an inflatable tire and hub assembly for toys, and in particular to a hub assembly utilizing a balloon tire.

2. Brief Statement Of The Prior Art

Toy vehicles have been provided with wheels of various shapes to simulate balloon tires. Hollow form wheels of rigid materials are shown in U.S. Pat. Nos. 3,263,363; 3,264,780; 3,642,048; and 4,411,639. Solid form wheels which are formed of a soft compressible material, such as an elastomer, are disclosed in U.S. Pat. Nos. 3,321,863; and 3,445,958. Similar wheels are disclosed as being covered with an outer coating or fabric in U.S. Pat. Nos. 3,408,770 and 4,146,992. In all of these prior wheels, the tire was either formed of a rigid supporting material, or was formed of a solid core, compressible material, to simulate an inflated balloon tire.

U.S. Pat. No. 3,264,780 discloses a hollow form rubber tire without any inflation pressure. U.S. Pat. No. 997,115 discloses an early attempt to provide an inflated balloon tire. According to the latter patent, a female hub member was placed about the neck of a balloon, the balloon was inflated, and a male hub element was then inserted and comented in place. A third hub element was then cemented about the outside face of the female hub member. The patented invention has a complex structure which is unsuited for mass production, and has the following failings; the permanent attachment of the balloon to the hub, the inability to change tires, and the failure to provide an inflation valve.

BRIEF DESCRIPTION OF THE INVENTION

This invention comprises toy ballon tire, and a two part hub assembly of a hub member and a cap member. The hub member has a peripheral rim about one end, a through passageway, and a sealing face on its surface which surrounds the through passageway, and the balloon tire has a single central opening which is received over the hub member and is seated against the rim of the hub member. The cap member is received over the balloon and is removably engaged to the hub member, retaining a sealing portion of said balloon in sealed engagement against said sealing face of the hub member.

The tire can be inflated by the application of air pressure to the through passageway. Once inflated, the air is retained in the tire by the sealing portion of the balloon which seats against the sealing face of the hub member. A valve release can be provided by a pin which is placed in the through passageway with an enlarged head portion that is received in a counterbore of the passageway. The pin can be pressed to lift the sealing portion of the balloon off the sealing face of the hub member, to deflate the tire and various mechanisms can be provided to simulate blow-outs and flats which can present challenges in competitive racing situations.

BRIEF DESCRIPTION OF THE DRAWINGS

The invention will be described by reference to the FIGURES, of which:

FIGS. 4 and 5 illustrate an assembly method for the wheel shown in FIG. 3;

FIGS. 6 and 7 are elevational sectional views of wheels of the invention which include an inflating mechanism;

FIGS. 8–13 show various embodiments of the invention which can be used to achieve special effects;

FIG. 14 illustrates an embodiment of the invention with a different release valve mounting; and FIG. 15 is a view of a portion of the view of FIG. 14, illustrating the position of the tire bead which releases the air pressure in the event the tire is overinflated.

DESCRIPTION OF PREFERRED EMBODIMENTS

Figure 1:
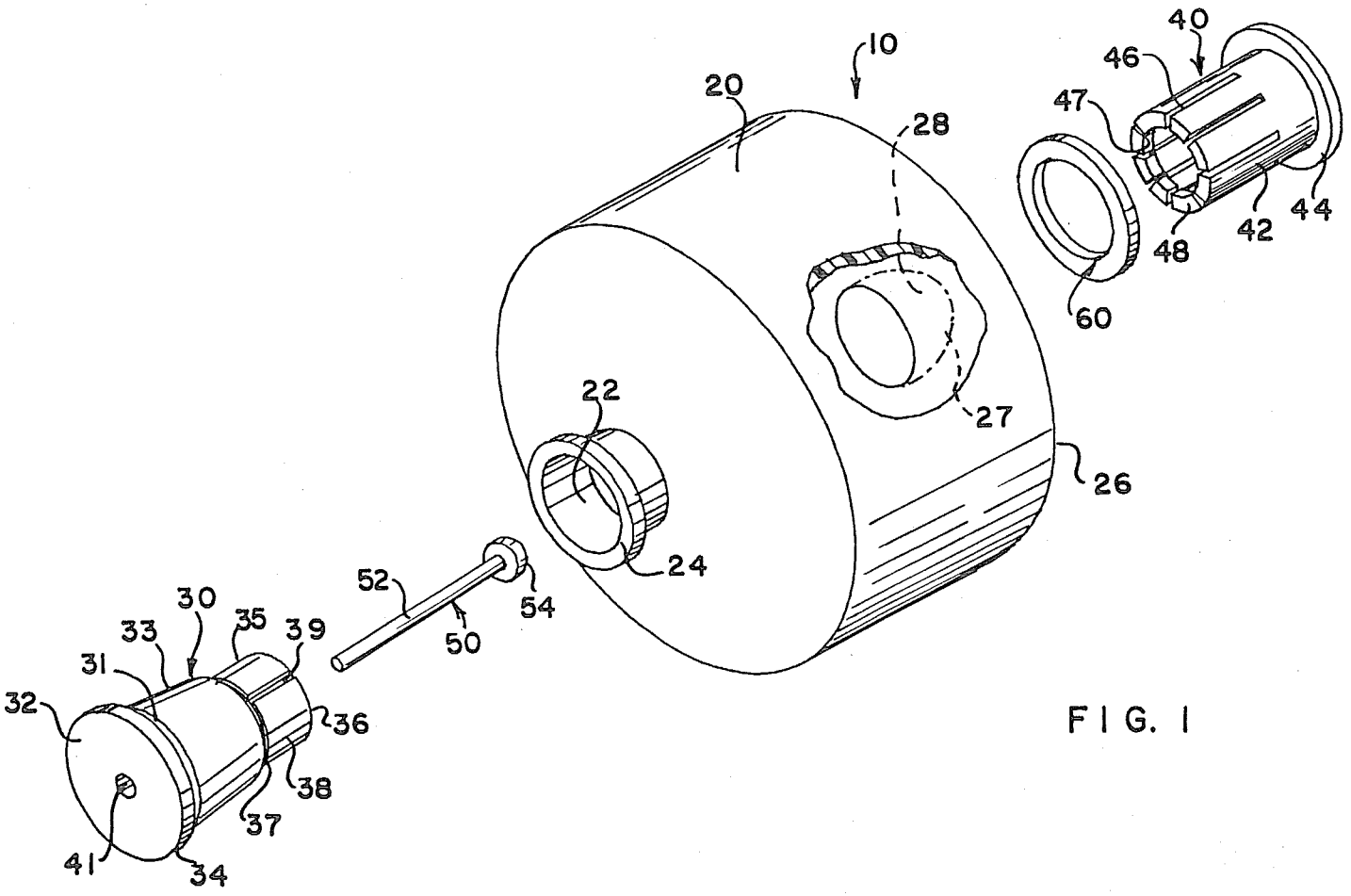
FIG. 1 is an exploded perspective view of the wheel of the invention.

Referring now to FIG. 1, the invention is a wheel 10 formed of a elastic balloon 20, and a two piece hub assembly of hub member 30 and cap member 40. A valve release member 50 and a retainer ring 60 can also be provided.

The balloon 20 is formed of an elastomeric material, e.g., natural or synthetic rubber latex, and can be shaped to a general tire configuration. The balloon has a single opening 22 which is preferably encircled with a bead 24 of the rubber latex. The opposite end 26 of the balloon can be flat, or preferably can be formed with a bulbous extension 28, which is shown through the cutaway portion of the illustration. The balloon can be readily manufactured from a natural or synthetic rubber latex by conventional rubber part forming techniques. Typically this is accomplished by preparing a metal mandrel for the part, coating the mandrel with a latex coagulant, and dipping the coated mandrel into the rubber latex, for a sufficient time to obtain the desire thickness of the balloon wall. The mandrel is then removed, excess latex is drained, and the rubber is cured, usually by air drying, to form the rubber part. Prior to curing, the end of the part which is formed on the mandrel can be rolled to form the bead 24. After curing, the rubber part is stripped from the mandrel to obtain the balloon 20, illustrated herein.

The hub member 30 has an outside face 32 which supports a peripheral rim 34, and has a through passageway 41 which extends from the outer face 32 to a sealing face 36 which is on a surface of the hub member which is within the balloon 20. In the illustrated embodiment, sealing face 36 is at the inside end 38, which is opposite end 32. In the illustrated embodiment, the hub member 30 has a short cylindrical section 31 adjacent its rim 34, a tapered section 33, and a short inner cylindrical section 35. An annular groove 37 is provided about the latter section, and one or more axial grooves 39 are provided along the length of the inner cylindrical section 35 and into face 36 and section 33, as shown hereinafter.

The cap member 40 has a sleeve section 42 which extends from its end flange 44. The sleeve section 42 has an inner diameter closely conforming to the outer diameter of cylindrical section 35 of the hub member 30, and has one or more axial slits 46 which extend from its inner end 48. An inner annular lip 47 is provided at the end of the sleeve section 42. In the assembly, described in greater detail with regard to FIG. 2, the cap member 40 is received over bulbous extension 28 of balloon 20 and cylindrical section 35 of the hub member 30, tightly stretching a sealing portion 27 of the balloon 20 against the sealing face 36 of the hub member. The retainer ring 60 is slipped over this assembly, snuggly compressing the sleeve section 42 against the cylindrical section 35. The valve release member 50 has a shaft 52 with an enlarged head 54, and is received in the passageway 41. For this purpose, passageway 41 has an enlarged diameter counterbore to receive the head 54 of the release member 50.

Figure 2:
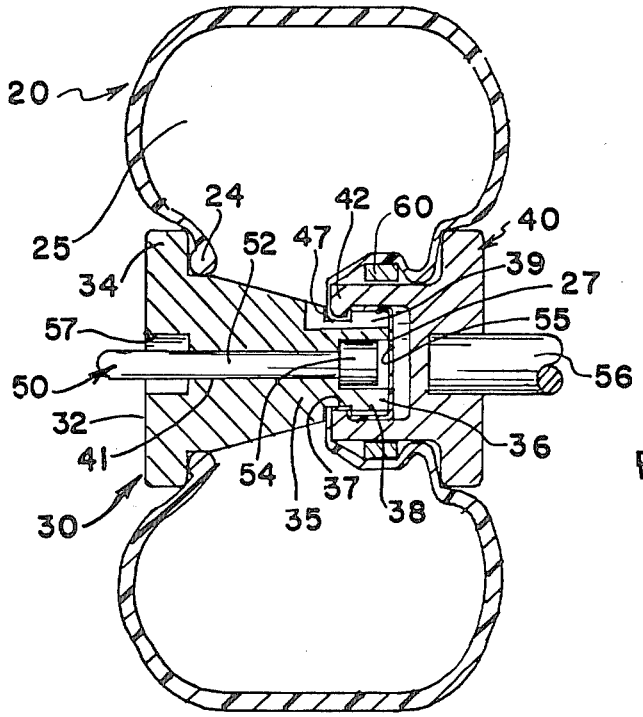
FIG. 2 is an elevational sectional view of the wheel of FIG. 1.

Referring now to FIG. 2, the assembled wheel is illustrated in sectional view. The hub member 30 is received within balloon 20 with bead 24 firmly secured against the peripheral rim 34. The sealing portion 27 of the balloon 20 is stretched tightly across the sealing face 36 of the inner end 38 of the hub member, and thus functions as a diaphragm of a valve member. The cap member 40 engages the inner end 38 of the hub member 30 in a male/female cooperative engagement, with the sleeve section 42 of the cap member received about the cylindrical section 35 of the hub member 30. The retention of the assembly is enhanced by detent means comprising the annular groove 37 in hub member 30 which receives the annular lip 47 of the cap member. This lip 47 is firmly seated and locked in engagement with annular groove 37 by retainer ring 60 which is slipped over the asembled hub members.

The cap member can have a central bore to receive a stub shaft 56 for mounting the wheel assembly to a toy vehicle.

The valve release member 50 is shown in the through passageway 41 with its head 54 received in the counterbore 55 of passageway 41, and with its shaft 52 extending through the passageway and projecting beyond the outer face 32 of the hub member 30. Preferably the passageway 41 is also counterbored at 57 to receive the end of an air supply conduit.

Once the wheel is assembled as shown in FIG. 2, it can be inflated by the application of a pressured source of air to the central passageway 41. The air pressure is sufficient to overcome the tension on the sealing portion 27 of the balloon 20, lifting it from the sealing face 36. The air then passes along the axial groove 39 in the cylindrical section 35 of the hub member 30, entering the interior 25 of the balloon 20. When the pressured source of air is removed from passageway 41, the sealing portion 27 of the balloon 20 reseats against the sealing face 36 of the hub member 30, retaining the balloon at the inflation pressure. If the air is to be released, the valve release member 50 is pressured, forcing head 54 against the sealing portion 27 of the balloon, lifting it off the sealing face 36 and releasing the air from the interior of the balloon.

Figure 3:
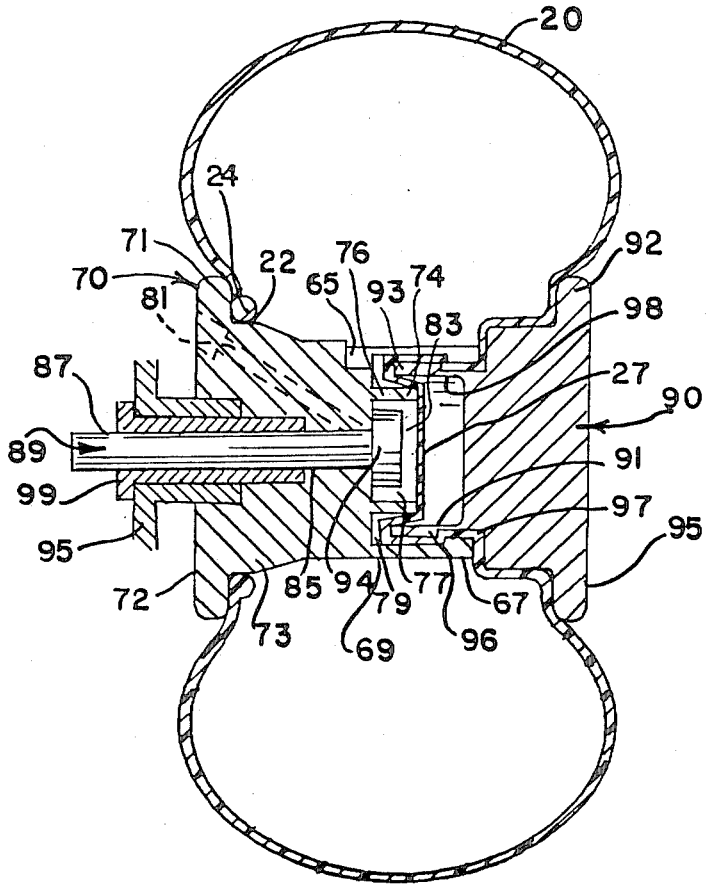
FIG. 3 is an elevational sectional view of another wheel embodiment of the invention.

The wheel assembly which is shown in FIG. 3 has a balloon tire 20 substantially the same as previously described, however, the central hub has a slightly different construction than that of FIGS. 1 and 2. The hub member 70 has a peripheral rim 71 about its outer face 72 with a conical section 73 and a short inner cylindrical section 69. The inner end 74 of the hub member 70 has a central bore 77 and an annular groove 79, thereby providing an annular rim 76 which serves as the sealing face for the valve, and a cylindrical skirt 67. The cylindrical skirt 67 has one or more axial slits 65, which are shown in FIG. 4 which includes a view of the hub member 70.

A through passageway 81 extends diagonally through hub member 70, from its outer face 72 to its inner end 74, discharging into the chamber 83 surrounded by rim 76. The hub member 70 also has a central through bore 85, and a valve release member 87 with a shaft 89 and an enlarged head 94 is loosely received in this through bore, with its head captured in chamber 83.

The cap member 90 also has a peripheral rim 92 about its outer face 95 and has a short cylindrical section 96, and a reduced diameter cylindrical section 98 having an outer diameter matching the inside diameter of the bore 79 of hub member 70, thereby providing a male/female engagement means between these two members. Preferably, the inner end of the cap member 90 has a central bore 91 to provide an annular lip 93. Detent means, in the form of an annular groove 97 on cylindrical section 98, and an inner annular lip on the inside edge of skirt 67 can be provided to firmly interlock the assembly, and the axial slots 65 in the cylindrical skirt 67 will provide sufficient flexing of the skirt 67 to receive the cylindrical section 98.

The balloon 20 is substantially identical to that described with reference to FIGS. 1 and 2. It has a single, central opening 22 with a peripheral bead 24 which is seated against the rim 71. The sealing portion 27 of the balloon is firmly seated in a sealing relationship against the rim 76 of hub member 70 by the annular lip 93 of cap member 90 which stretches the sealing portion 27 of the elastomeric balloon as it is seated into the hub member 70.

The application of air pressure to the through passageway 81 will lift the sealing portion 27 of the balloon from the sealing rim 76 of hub member 70, permitting the air to enter the annular chamber 101. The axial slots 65 in the cylindrical skirt 67 provide venting of the air into the interior chamber of the balloon.

A wheel support shaft 95 and bearings 99, as needed, can be mounted in central bores in either the hub member 70 or the cap member 90.

Referring now to FIGS. 4 and 5, the assembly of the wheel shown in FIG. 3 will be described. In these illustrations, the balloon and cap members are shown in cross sectional view, while the hub member is is full view. The wheel 10 can be readily assembled by reversing the balloon 20 inside out, and placing it over the cap member 90 with its bulbous extension 28 seated over the cylindrical section 96. The valve release member 87 is placed in the through bore of the hub member 70 and this subassembly is then inserted over the balloon and cap member subassembly by urging the slotted skirt 67 over the section 96 until the inner annular lip seats in the annular groove 97 of the cap member 90. The retaining ring 61, when present, is then moved from its retracted position of FIG. 4 to its locking position shown in FIG. 5.

The balloon 20 is then turned right side out, to the configuration shown in FIG. 5, and the bead 24 is stretched slightly to permit it to be passed over the rim 71 of the hub member, as shown by arrowhead line 118. In this position, the balloon 20 can be inflated by the application of air pressure through the passageway 81 of hub member 70.

The wheel previously described requires a source of air pressure for inflation, which can simply be a small air bellows with a tubular sleeve discharge that seats in an internal passageway, such as 81 (see FIG. 3).

The air bellows can also be provided in the wheel structure itself, as shown in FIG. 6. The wheel 10 illustrated in FIGURE 6 has a hub member 130 with a peripheral rim 132 and a short cylindrical inner end 134 which is received in a sleeve section 142 of the cap member 140, all similar to the embodiment shown in FIGS. 1 and 2. The hub member 130 has a central bore 136 and a communicating through passageway 141. The sealing portion 27 of the balloon 20 is stretched during assembly of the hub and cap members and is seated against the sealing face 146 of the hub member 130. One or more axial grooves 139 are provided in the cylindrical end 134 of the hub member.

The valve release member 150 of the assembly has a shaft 152 which is slidably received in the through passageway 141. This shaft can be fluted with one or more longitudial grooves 155, and has a central through bore 156. The release member 150 has an enlarged diameter head 157 which has an annular groove 159. An air bellows 160, which is formed of a suitable plastic such as polyethylene, polypropylene, or elastomeric materials such as natural or synthetic rubbers is seated in the central bore 136 of the hub member 130. The outer end 162 of the bellows 160 has a central aperture which receives the head 157 of the valve release member 150 and seats in groove 159 about the head 157. The inner end 166 of the bellows 160 has a short skirt which is mounted in a counterbore in through passageway 141, surrounding the shaft 152 of the release member 150.

In operation, one places one's finger over the passageway 156 of the head 157 of the valve release member, and compresses the air bellows 160. This discharges air along the longitudinal grooves 155 in shaft 152 of the valve release member, lifting the sealing protion 27 of the balloon 20 off the sealing face 146 of the hub member 130. Air is then discharged through the axial grooves 139, into the interior 25 of the balloon 20. The pressure in the balloon can be relieved simply by pressing the valve release member 150 to lift the sealing portion 27 of the balloon and permitting the air to discharge through the central passageway 156 of the release member.

Figure 7:
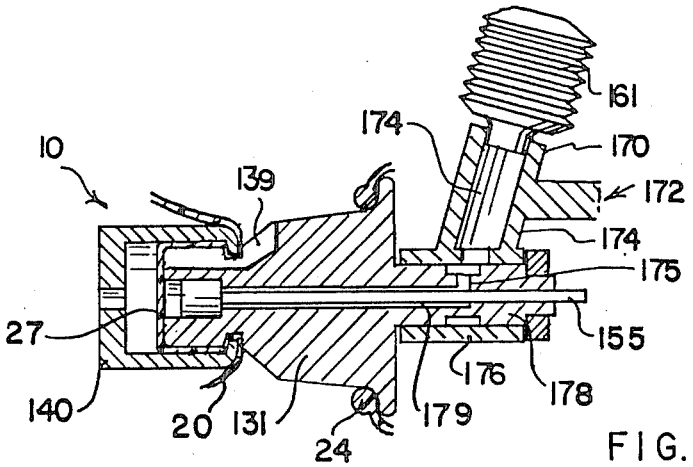

Referring now to FIG. 7, an alternative embodiment is shown. In this embodiment, the air bellows 161 is mounted in a boss 170 of the toy vehicle 172. The external mounting of the air bellows 161 on the vehicle thus simulates a shock absorber. At its lower end 174, the boss supports a trunion 176 that receives a stub shaft 178 from the hub member 131 of the wheel 10. This wheel uses substantially the same cap member 140 and valve configuration as shown in FIG. 6. The stub shaft has a central bore 179 which receives the valve release member 155. The stub shaft 178 has a small diameter counterbore 177 at its outer end which snuggly receives the shaft of release member 155. The air bellows 161 discharges into a central passageway 174 in the boss 170. An annular groove 173 is provided about the stub shaft 178, communicating with the passageway 174, and one or more apertures 175 are provided in shaft 178 which extend to the central bore 179.

Figure 8:
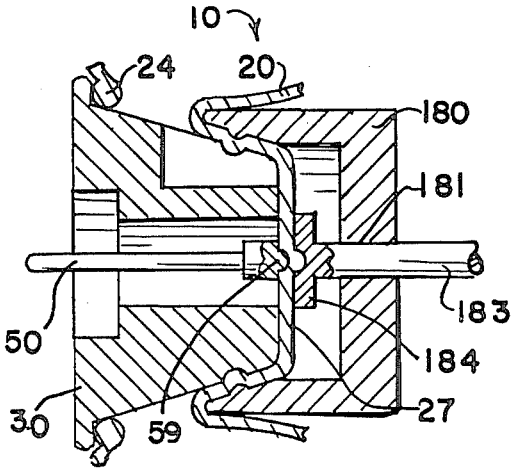

Referring now to FIG. 8, the wheel 10 is shown with a valve release mounted in the cap member. The hub member is substantially the same as hub member 30, previously described. The cap member 180 is provided with a through passageway 181 in which a release member 183 is slidably mounted. The release member has an enlarged head 184 which seats against the sealing portion 27 of the balloon and is fixedly secured thereto by the hub release member 50. For this purpose, the head 184 can have a central recess which receives the end 59 of the hub release member 50 in a friction fit, firmly securing the sealing portion 27 of the balloon 20. In this embodiment, the air pressure of the balloon tire 20 can be released from either side by release member 50 or release member 183.

Figure 9:
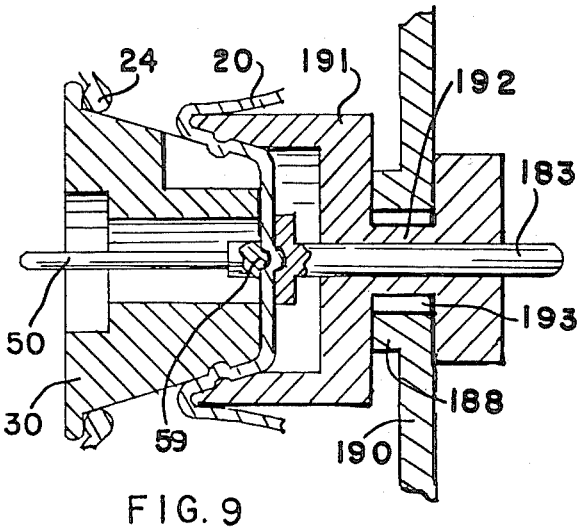

FIG. 9 illustrates a typical stub axle mounting of the wheel. In this embodiment, the cap member 191 has a stub axle 192 which can be integral, as shown, which is received in a journal 188 on the frame 190 of a vehicle. Suitable bearings 193 can be provided, as desired.

Figure 10:
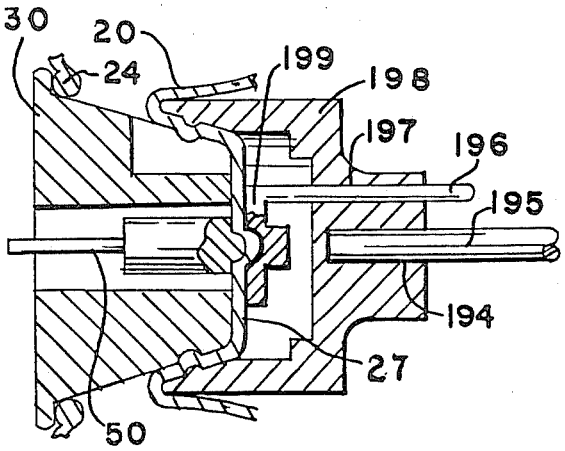

FIG. 10 illustrates a typical solid axle mounting. In this embodiment, the cap member 198 has a central bore 194 which receives the end of an axle 195 in a friction, or splined fit. The release member 196 is mounted in an eccentrically located bore 197 in the cap member 198, and has an arm 199 which extends into a pinned engagement with the end of the release member 50, to firmly secure the sealing portion 27 of balloon 20.

Figure 11:
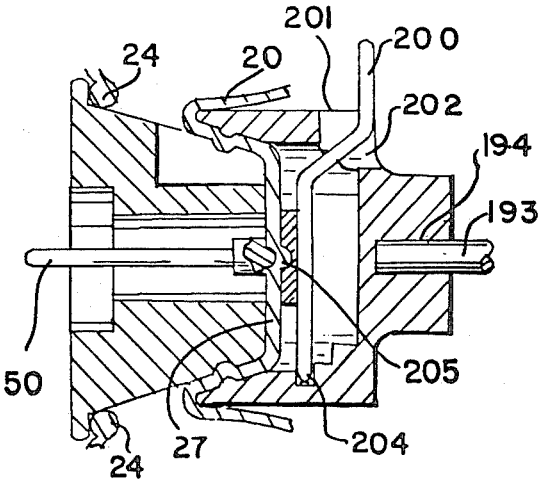

FIG. 11 illustrates an axle mounting similar to that of FIG. 9, however, the release member is a lever 200 which is received in a pocket 202 in the cap member 201. The lever is pivotally mounted in pocket 202 at its fulcrum end 204. The lever has a center boss 205 which is pinned to the sealing portion 27 of the balloon 20 by the release member 50, similar to the construction of FIGS. 8–10.

FIG. 12 illustrates an axle mounting in which the wheel is provided with a blow out simulation caused by hard cornering of the vehicle. In this embodiment, the axle 195 is received in a central bore 206 of the cap member 180 and has a bore 210 on its end which receives the sealing portion 27 of balloon 20 and the end of release lever 50 in a friction fit. Any substantially deflection of the hub member 30, such as resulting from too hard cornering, will cause the rigid axle to lift the sealing portion 27 off the sealing face 207 of the hub member, releasing the air pressure in the balloon 20.

FIG. 13 illustrates another embodiment in which the wheel 10 is supported by the hub member 220. In this embodiment, the hub member 220 has a center bore 222 which receives the end of an axle 195, and the through passageway for application of air pressure during inflation is provided by a diagonal passageway 224. If desired, a release member 223 can be provided in a separate through bore 225, which is also located off center.

Referring now to FIG. 14, an alternative wheel construction is illustrated with a separate valve member. In this embodiment, the cap member 228 has a central bore 226 to receive the mounting shaft 195, an end flange 230, and a central conical section 232 which is received by cylindrical skirt section 234 of the hub member 236. Detent means, in the form of an inner annular lip 238 on skirt section 234 and an annular groove 240 in the conical section 232, is provided to retain the assembly. The hub member 236 has a central bore 242 which is counterbored at 244. The inner end of bore 236 provides a valve seat 246 and a valve member 248 which is supported on the end of valve release pin 250 is biased against the valve seat by compression spring 252. The valve release pin 250 has a head 254 which serves also as a retainer for spring 252. The counterbore 244 has an internal diameter 245 to receive the end of a flexible tubing of an air bellows to permit inflation of the balloon tire 20.

The embodiment of FIG. 14 also has a feature which can be incorporated in any of the aforementioned embodiments of the invention to provide a contolled release of the air pressure in the balloon, thereby preventing overinflation of the tire. This feature comprises two end flanges on the hub. The first flange, 237 serves to retain the open end of the balloon with the bead 24 of balloon 20 seating against the flange, all as previously described for the other disclosed embodiments. An outer flange 239 is also provided, with at least one, and preferably, several, slots 241 which extend entirely through, and slightly past, the outer flange 239. In the event that the balloon is overinflated, the inflation pressure is sufficient to cause the bead 24 to expand, and lift to the outer flange 239, as shown in FIG. 15. In this position, the slots 241 provide an air passageway (shown by phantom arrowhead line 243) for release of the air pressure within the balloon 20.

The invention provides a number of features and advantages which can be utilized in various applications. The inflated tire provides a realism for toy vehicles which has not been achieved in prior tire assemblies, since the tires can be inflated to a desired operating pressure; tire can be changed for different operations, e.g., deep treads can be applied to simulate off-road racing, or slick tires with little or no tread can be applied to simulate dragster racing; blow-outs can be simulated, e.g., when the valve operator is struck or deflected by an obstruction on the track, or by a competitive racing vehicle. Competitive racing can include required tire changes in pit stops, thereby heightening the competition between racers. The tires, which are rubber balloons of a special shape and design, can be manufactured simply and inexpensively, and can be manufactured in a wide variety of shapes, i.e., profiles, and tread designs, all contributing to a high degree of realism of the toy vehicle. The ease of manufacture of the tires also permits custom tire preparation, thus permitting experimentation with different shapes and tread designs, and thereby providing serious racing fans with an added dimension in competitive racing. The extremely low weight of the hub assembly and tire can also provide an advantage for model aircraft applications. As a further advantage, toy tire chains can be applied to the tire; preferably by slightly deflating the tire, applying the tire chains and securing them about the tire, and then inflating the tire to apply the desired tension to the surrounding tire chains.

The invention has been described with reference to the illustrated and presently prefered embodiment. It is not intended that this disclosure of the presently prefered embodiment be unduly restricting. Instead, it is intended that the invention be defined by the means, and their obvious equivalents, set forth in the following claims:

What is claimed is:

1. A toy tire assembly comprising:

(a) an elastomeric balloon having a single central opening at one end;

(b) a hub member having a peripheral rim about one end, with its opposite end received in said balloon and with said single central opening of said balloon seated against said peripheral rim;

(c) a cap member received over the outside surface of the opposite end of said balloon from said central opening, and cooperative engagement means between said opposite end of said hub member and said cap member, forming a hub assembly of said cap member removably interlocked to said hub member with said opposite end of said balloon engaged therebetween;

(d) a through passageway communicating from the outside of said hub, through said hub to the interior of said balloon; and (e) valve means operatively seated in said through passageway to seal the interior of said balloon.

2. The toy tire assembly of claim 1 wherein said valve means includes a sealing face on an inside surface of said hub which surrounds said through passageway.

3. The toy tire assembly of claim 2 wherein said valve means also includes a valve member mounted in said through passageway distally carrying a valve seat member with resilient means to bias said valve seat member against said scaling face on said hub member.

4. The toy tire assembly of claim 3 wherein said through passageway comprises a through bore and a communicating slot in said hub member to provide an air passageway from said through bore to the interior of said balloon.

5. The toy tire assembly of claim 2 wherein said valve means comprises said sealing face on said hub member surrounding said through passageway, and the inside surface of said balloon which is received in sealing engagement over said sealing face.

6. The toy tire assembly of claim 5 wherein said valve means includes a valve operator formed by a shaft slidably received in said through passageway with its inside end bearing against said inside surface of said balloon and operative to lift said inside surface of said balloon off said sealing face.

7. The toy tire assembly of claim 6 wherein said through passageway has an enlarged diameter counterbore in said through passageway and said valve operator has an enlarged head seated in said counterbore, thereby capturing said valve operator in said hub assembly.

8. The toy tire assembly of claim 7 wherein said valve operator projects from said hub to provide lever means for releasing the inflation pressure of said tire during operation of a toy vehicle supporting said tire, thus simulating blowouts.

9. The tire of claim 5 including at least one axial slot along the opposite end of said hub, and intersecting said sealing face to provide an air passageway between the interior of said balloon and said through passageway when the inside portion of said balloon is lifted from said annular sealing face.

10. The tire of claim 1 wherein said cooperative engagement means comprise male and female interlocking means on said opposite end of said hub member and said cap member.

11. The tire of claim 1 wherein said opposite end of said hub member is cylindrical and said cap has a cylindrical sleeve portion which is received over said cylindrical, opposite end of said hub member.

12. The tire of claim 11 including snap engagement means between said hub member and said cap.

13. The tire of claim 12 wherein said snap emgagement means comprises an annular groove about said hub and cooperative annular rim about the inside of said sleeve portion of said cap.

14. The toy tire assembly of claim 13 wherein said hub has at least one axial slot which intersects said sealing face to provide an air passageway between the interior of said balloon and said through passageway when the inside portion of said balloon is lifted from said annular sealing face.

15. The tire of claim 1 wherein the opposite end of said hub member has an annular end groove surrounding said passageway, and said cap member has a sleeve end which is received in said annular end groove, stretching said sealing portion of said balloon therebetween.

16. The tire of claim 15 including an annular groove about the outer wall of said cap member and an interlocking annular rim about the inside end of said hub member, thereby providing interlocking means between said cap and hub members.

17. The toy tire assembly of claim 16 wherein said valve means includes a valve operator formed by a shaft slidably received in said through passageway with its inside end bearing against said inside surface of said balloon and operative to lift said inside surface of said balloon off said annular sealing face.

18. The toy tire assembly of claim 16 wherein said through passageway has an enlarged diameter counterbore on the inside end of said hub and said valve operator has an enlarged head seated in said counterbore, thereby capturing said valve operator in said hub assembly.

19. The toy tire assembly of claim 18 wherein said valve operator projects from said hub to provide lever means for releasing the inflation pressure of said tire during operation of a toy vehicle supporting said tire, thus simulating blowouts.

20. The toy tire assembly of claim 5 wherein said valve means also includes a cap valve operator moveably mounted in said cap member and projecting therethrough with an enlarged head received in said cap member and fixedly secured to the outside surface of said balloon opposite said sealing face of said hub member.

21. The toy tire assembly of claim 20 wherein said valve means also incluses a hub valve operator slidably received in said through passageway of said hub member with an end received in said hub member and interconnected to said cap valve operator, with the said balloon secured therebetween.

22. The toy tire assembly of claim 21 wherein said cap valve operator is slidably received in a through bore in said cap member.

23. The toy tire assembly of claim 21 wherein said cap valve operator is pivotally received in said cap member.

24. The toy tire assembly of claim 1 wherein said peripheral rim comprises first and second, stepped diameter rims with at least one axial rim slot through and slightly beyond said outermost rim, whereby said central opening of said balloon seats against the innermost of said two rims for normal inflation and expands to seat against the outermost of said rims when the inflation pressure exceeds a predetermined amount, thereby venting the interior of said balloon through said axial rim slot.

* * * * *